US010889476B2

(12) United States Patent
Hoover

(10) Patent No.: US 10,889,476 B2
(45) Date of Patent: Jan. 12, 2021

(54) DEVICE AND METHOD FOR SECURING END OF BRAIDED HOISTING ROPE TO LIFTING DEVICE

(71) Applicant: KONECRANES GLOBAL CORPORATION, Hyvinkää (FI)

(72) Inventor: Jack Hoover, Hyvinkää (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 0 days.

(21) Appl. No.: 16/615,437

(22) PCT Filed: May 29, 2018

(86) PCT No.: PCT/FI2018/050405

§ 371 (c)(1),
(2) Date: Nov. 21, 2019

(87) PCT Pub. No.: WO2018/220276

PCT Pub. Date: Dec. 6, 2018

(65) Prior Publication Data

US 2020/0079626 A1 Mar. 12, 2020

(30) Foreign Application Priority Data

May 31, 2017 (FI) ..... 20175491

(51) Int. Cl.
*B66D 1/34* (2006.01)

(52) U.S. Cl.
CPC ..... *B66D 1/34* (2013.01)

(58) Field of Classification Search
CPC .. B66D 1/34; B66B 7/08; B66B 7/085; B66B 11/0075; B66B 19/02; B65H 75/28; F16G 11/00; E21B 17/023
See application file for complete search history.

(56) References Cited

U.S. PATENT DOCUMENTS 2,266,883 A * 12/1941 Lukes ..... F16G 11/048 403/365
2,584,099 A * 1/1952 Harkrader ..... B66D 1/34 242/602.2

(Continued)

FOREIGN PATENT DOCUMENTS

JP 54-89772 U 6/1979
WO WO 94/20770 A1 9/1994

OTHER PUBLICATIONS

International Search Report, issued in PCT/FI2018/050405, dated Jun. 12, 2018.

(Continued)

*Primary Examiner* — Sang K Kim
*Assistant Examiner* — Nathaniel L Adams
(74) *Attorney, Agent, or Firm* — Birch, Stewart, Kolasch & Birch, LLP

(57) ABSTRACT

A device for securing an end of a braided hoisting rope to a lifting device includes a tubular fastening frame to be fixed to the lifting device; and a coil spring which is arranged to be installed and fastened over the tubular fastening frame. When the end of a hoisting rope is fastened in place, the hollow, or workable into hollow, end of the hoisting rope is threaded over the windings of the coil spring as the outer surface of the windings and into contact with, or to be brought into contact with the outer periphery of the tubular fastening frame. A method for securing an end of a braided hoisting rope to a lifting device is also disclosed.

20 Claims, 1 Drawing Sheet

(56) References Cited

Figure 1:
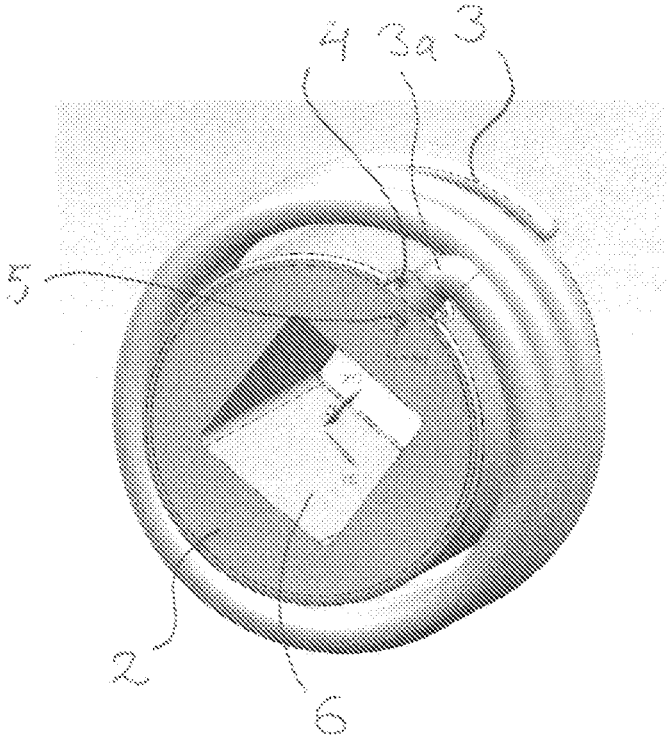

U.S. PATENT DOCUMENTS 3,422,501 A * 1/1969 Yoshimura ..... E04C 5/122
24/122.6
5,526,552 A 6/1996 De Angelis

OTHER PUBLICATIONS

Written Opinion of the International Searching Authority, issued in PCT/FI2018/050405, dated Jun. 12, 2018.

* cited by examiner

DEVICE AND METHOD FOR SECURING END OF BRAIDED HOISTING ROPE TO LIFTING DEVICE

BACKGROUND OF THE INVENTION

The invention relates to a device and method for securing an end of a braided hoisting rope to a lifting device.

In hoisting ropes of a steel material, it is known to use a wedge pocket by means of which the hoisting rope is secured to a lifting device. When it is desired to use a synthetic material, the use of a wedge pocket may damage the hoisting rope even if the fastening were reliable to begin with. A device for securing such a hoisting device is known from publication U.S. Pat. No. 5,526,552 A.

It is therefore the object of the present invention to develop a securing method for a hoisting rope of a synthetic material, specifically, which does not damage the hoisting rope but nevertheless guarantees a reliable fastening.

SUMMARY OF THE INVENTION

The object of the invention is achieved by the inventive device which is characterised in that it comprises a tubular fastening frame to be fixed to the lifting device; and a coil spring which is arranged to be installed and fastened over the tubular fastening frame; whereby when an end of a hoisting rope is fastened in place, the hollow, or workable into hollow, end of the hoisting rope is threaded over the windings of the coil spring as the outer surface of the windings and into contact with, or to be brought into contact with the outer periphery of the tubular fastening frame.

The method according to the invention is in turn characterised by arranging a tubular fastening frame to be fastened to a lifting device; arranging a coil spring installed and fastened over the tubular fastening frame; arranging a braided hoisting rope, an end of which is formed hollow or formable hollow; threading an end of the hoisting rope over the coil spring; and fastening the coil spring over the tubular frame either before threading the hoisting rope over it or after the hoisting rope has been threaded over the coil spring.

The invention is based on that the hoisting rope threaded over the coil spring fastened or to be fastened to the fastening frame as a holder in the lifting device will tighten around the coil spring, and the entity formed by the hoisting rope and coil spring in turn around the fastening frame, the hoisting rope stays locked in place mainly by way of friction.

When there are enough rope turns of the entity formed by the coil spring and hoisting rope around the fastening frame, for example at least approximately three turns, the fastening friction is spread out on an adequately wide fastening surface area, whereby the hoisting rope will not get damaged. This fastening surface area may be widened and thus the fastening friction enhanced by forming a spiral-like grooving on the surface of the tubular fastening frame, which meshes with the outer surface of the rope installed on the windings of the coil spring. Alternatively, instead of the grooving or in addition to the grooving, the outer surface of the fastening frame may have a roughening.

It is easy to install the hoisting rope to the fastening frame as long as the fastening frame is made to be detachable from the lifting device in a simple enough manner, for example by means of an angular or grooved centre hole in the fastening frame, fastenable to a fastening axle of a similar form on the lifting device. In such a case, the detaching of the fastening frame takes place by simply pulling the fastening frame from the fastening axle.

The coil spring is advantageously made of a steel material, most advantageously of spring steel. The fastening end of the coil spring may be bent and fastened to the tubular fastening frame by form locking, or to a recess in the periphery of the fastening frame by a screw fastening. The surface of the coil spring may be roughened, too. So, the surfaces of both the fastening frame and the coil spring may be roughened, or one of them roughened, or no roughening on either one.

The securing of the hoisting rope to the tubular fastening frame and/or coil spring may also be ensured by separate mechanical fastening means.

LIST OF FIGURES

Figure 2:
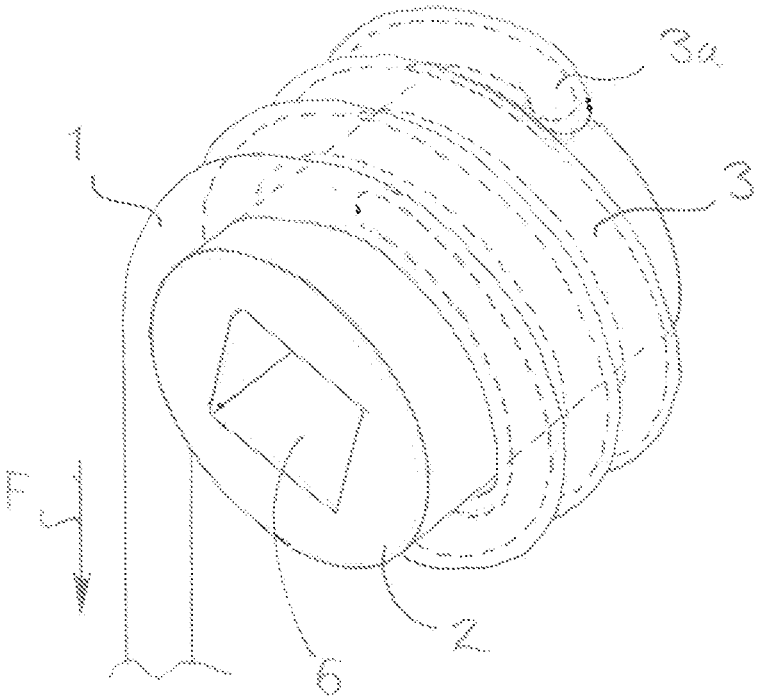

The invention is now described in closer detail by means of one preferred embodiment and with reference to the accompanying drawings, in which FIG. 1 shows the device according to the invention without the hoisting rope; and FIG. 2 shows the device according to the invention with the hoisting rope installed.

DETAILED DESCRIPTION OF THE INVENTION

With reference to FIG. 1, the inventive device for securing an end of a braided hoisting rope 1 of a synthetic material, specifically, to a lifting device comprises as its main components a tubular fastening frame 2 fastened to the lifting device, and a coil spring 3 which is arranged to be installed and fastened over the outer periphery of the tubular fastening frame 2. The definition end of hoisting rope 1 must here be interpreted as a particular portion of the hoisting rope, starting from its "end". The lifting device or hoist is not described herein, because it is not essential for the invention.

The coil spring 3 may be fastened over the tubular frame 2 either before the end of the hoisting rope 1 is threaded over it, or after the hoisting rope 1 has been threaded over the coil spring 3. For this, the windings of the coil spring 3 are in such a way at a small distance from the outer periphery of the fastening frame 2 that the hollow, or workable into hollow, end of the hoisting rope 1 may be threaded on the windings even if the coil spring 3 were fastened in place. So, the inner diameter of the coil spring 3 is smaller than the outer diameter of the fastening frame 2. The essential issue is that when the end of the hoisting rope 1 is secured in place, its hollow, or workable into hollow, end is threaded over the windings of the coil springs as the outer surface of the windings and into contact or to be brought into contact with the surface of the tubular fastening frame 2. The bringing of the end of the hoisting rope 1 into a tight or non-slipping contact with the periphery of the fastening frame 2 takes place or must take place at the latest when tensile force F caused by lifting a load is exerted on the hoisting rope 1.

The outer periphery of the tubular fastening frame 2 may be provided with a spiral-like grooving, which meshes with the outer surface of the hoisting rope 1 installed over the windings of the coil spring 3. Alternatively, instead of the grooving or in addition to the grooving, the outer surface of the fastening frame 2 may have a roughening.

The coil spring 3 may have approximately 2.5 to 3.5 windings over the tubular fastening frame 2. The fastening end 3*a* of the coil spring 3 is advantageously bent and fastened to a recess 4 in the periphery of the tubular fastening frame 2 by a screw fastening 5. The coil spring 3 may be of spring steel, for example. The surface of the coil spring 2 may be roughened, too.

The tubular fastening frame 2 has a centre hole 6 for attaching the tubular fastening frame 2 to the lifting device. The centre hole 6 may be angular, as shown in FIG. 1, or grooved in the longitudinal direction, for example.

The securing of the end of the hoisting rope 1 to the tubular fastening frame and/or coil spring may also be ensured by separate mechanical fastening means, if so required.

In a prototype implementation, in which the minimum break force of the hoisting rope was 50 kN, a coil spring with the diameter of 8 mm (SF-TFV 8×80×100 EN 10270-1-SM) was used. The inner diameter of this coil spring was 80 mm, whereby 60 mm was chosen as the diameter of the fastening frame. The periphery of the fastening frame was non-grooved. With this implementation, the maximum friction force of 41 kN was reached between the fastening frame and hoisting rope.

In an ideal case, the diameters of the hoisting rope 1 and coil spring 3 are substantially equal. If the coil spring 3 is too thin (so, clearly thinner than the hoisting rope 1), the hoisting rope 1 will not stay in it. If the coil spring 3 is too thick (so, clearly thicker than the hoisting rope 1), the strands of the hoisting rope 1 will cut around the coil spring 3. If the diameter dimension of 8 mm is used for the coil spring and the hoisting rope, it is advantageous to linearly thin the cross-section of the coil spring by approximately 70% over a distance of 100 mm from the end of the coil spring. If said diameter dimension is larger, thinning by a suitable amount is done over a longer distance.

The above description of the invention is only intended to illustrate the basic idea of the invention. A person skilled in the art may, however, implement its details within the scope of the attached claims.

The invention claimed is:

1. A device for securing an end of a braided hoisting rope to a lifting device, comprising:

a tubular fastening frame to be fixed to the lifting device; and a coil spring arranged to be installed and fastened over the tubular fastening frame;

wherein when an end of the hoisting rope is secured in place, a hollow, or workable into hollow, end of the hoisting rope is threaded over windings of the coil spring as an outer surface of the windings and into contact or to be brought into contact with a surface of the tubular fastening frame.

2. The device as claimed in claim 1, wherein the tubular fastening frame has a centre hole for attaching the tubular fastening frame to the lifting device.

3. The device as claimed in claim 2, wherein the centre hole is angular or grooved in a longitudinal direction.

4. The device as claimed in claim 3, wherein an outer periphery of the tubular fastening frame is provided with a spiral grooving, which meshes with an outer surface of the hoisting rope installed over the windings of the coil spring.

5. The device as claimed in claim 3, wherein there is a roughening on an outer periphery of the tubular fastening frame.

6. The device as claimed in claim 3, wherein the coil spring has approximately 2.5 to 3.5 windings over the tubular fastening frame.

7. The device as claimed in claim 2, wherein an outer periphery of the tubular fastening frame is provided with a spiral grooving, which meshes with an outer surface of the hoisting rope installed over the windings of the coil spring.

8. The device as claimed in claim 2, wherein there is a roughening on an outer periphery of the tubular fastening frame.

9. The device as claimed in claim 2, wherein the coil spring has approximately 2.5 to 3.5 windings over the tubular fastening frame.

10. The device as claimed in claim 1, wherein an outer periphery of the tubular fastening frame is provided with a spiral grooving, which meshes with an outer surface of the hoisting rope installed over the windings of the coil spring.

11. The device as claimed in claim 10, wherein there is a roughening on an outer periphery of the tubular fastening frame.

12. The device as claimed in claim 1, wherein there is a roughening on an outer periphery of the tubular fastening frame.

13. The device as claimed in claim 1, wherein the coil spring has approximately 2.5 to 3.5 windings over the tubular fastening frame.

14. The device as claimed in claim 1, wherein the coil spring is made of spring steel.

15. The device as claimed in claim 1, wherein a surface of the coil spring is roughened.

16. The device as claimed in claim 1, wherein a fastening end of the coil spring is bent and fastened to a recess in a periphery of the tubular fastening frame by a screw fastening.

17. The device as claimed in claim 1, wherein a fastening end of the coil spring is bent and fastened to the tubular fastening frame by form locking.

18. The device as claimed in claim 1, wherein the hoisting rope is of a synthetic material.

19. The device as claimed in claim 1, wherein the fastening of the hoisting rope to the tubular fastening frame and/or to the coil spring is additionally ensured by separate mechanical fastening means.

20. A method for securing an end of a braided hoisting rope to a lifting device, comprising the steps of:

arranging a tubular fastening frame to be fixed to a lifting device;

arranging a coil spring to be installed and fastened over the tubular fastening frame;

arranging a braided hoisting rope, an end of which is formed hollow or formable hollow;

threading an end of the hoisting rope over the coil spring; and fastening the coil spring over the tubular fastening frame either before threading the end of the hoisting rope over the coil spring or after the hoisting rope has been threaded over the coil spring.

* * * * *